US007097420B2

(12) United States Patent
Cormier et al.

(10) Patent No.: US 7,097,420 B2
(45) Date of Patent: Aug. 29, 2006

(54) METHODS AND APPARATUS FOR ASSEMBLING GAS TURBINE ENGINES

(75) Inventors: Nathan Gerard Cormier, Cincinnati, OH (US); James Edwin Rhoda, Mason, OH (US); Steven Roy Manwaring, Lebanon, OH (US)

(73) Assignee: General Electric Company, Schenecady, NY (US)

( * ) Notice: Subject to any disclaimer, the term of this patent is extended or adjusted under 35 U.S.C. 154(b) by 131 days.

(21) Appl. No.: 10/823,891

(22) Filed: Apr. 14, 2004

(65) Prior Publication Data

US 2005/0232763 A1 Oct. 20, 2005

(51) Int. Cl.
*F01D 9/04* (2006.01)

(52) U.S. Cl. ..... 415/119; 415/191; 415/194; 415/210.1; 415/211.2; 29/889.22

(58) Field of Classification Search ..... 415/119, 415/191, 194, 195, 208.2, 211.2, 210.1; 29/889.21, 29/889.22

See application file for complete search history.

(56) References Cited

U.S. PATENT DOCUMENTS

| | | | | |
|---|---|---|---|---|
| 1,534,721 | A * | 4/1925 | Lasche | 415/195 |
| 5,342,167 | A | 8/1994 | Rosseau | |
| 6,234,750 | B1 * | 5/2001 | Mielke et al. | 415/191 |
| 6,352,405 | B1 * | 3/2002 | Tomko | 415/209.2 |
| 6,439,838 | B1 | 8/2002 | Crall et al. | |

* cited by examiner

*Primary Examiner*—Christopher Verdier
(74) *Attorney, Agent, or Firm*—William Scott Andes; Armstrong Teasdale LLP

(57) ABSTRACT

A method of assembling a gas turbine engine includes providing a plurality of stator vane sectors that each include an equal number of stator vanes that are circumferentially-spaced such that a first circumferential spacing is defined between each pair of adjacent stator vanes within the sector, and coupling the plurality of stator vane sectors together to form a stator vane assembly such that a second circumferential spacing is defined between each pair of adjacent stator vanes coupled to adjacent sectors, wherein the second circumferential spacing is different from the first circumferential spacing.

17 Claims, 5 Drawing Sheets

METHODS AND APPARATUS FOR ASSEMBLING GAS TURBINE ENGINES

BACKGROUND OF THE INVENTION

This invention relates generally to gas turbine engines, and more specifically to vane sectors used in gas turbine engines.

At least some known gas turbine engines include, in serial flow arrangement, a fan assembly, a low pressure compressor, a high pressure compressor, a combustor, a high pressure turbine, and a low pressure turbine. The high pressure compressor, combustor and high pressure turbine are sometimes collectively referred to as the core engine. At least some known compressors include a plurality of rows of circumferentially-spaced rotor blades that extend radially outwardly from a rotor or disk. Adjacent rows of rotor blades are separated by a plurality of stator vane assemblies that are secured to the compressor casing. Each stator vane assembly includes a plurality of stator vanes, each of which includes an airfoil that extends between adjacent rows of rotor blades. At least some known stator vane assemblies include a plurality of stator vane segments that are circumferentially-joined together. Typically, the stator vane sectors are identical to each other, such that each stator vane sector spans an equal radial arc, and each vane sector includes an equal number of stator vanes.

Known airfoils have a series of natural frequencies associated with them. More specifically, each airfoil produces a wake in an air stream that is felt as a pulse by a passing airfoil. The combination of the number of stator vanes and the rotational speed of the compressor may coincide with a natural frequency of the rotor blades. The combination of the number of stator vane wakes (pulses) and the rotational speed of the compressor creates a stimulus that may coincide with a natural frequency of the rotor blades. Accordingly, in designing gas turbine engines, at least one design goal is to keep the majority of the airfoil natural frequencies outside of the designed engine operating range.

To reduce induced rotor blade vibrations, at least some known engines vary the vane spacing around the circumference of the engine casing to facilitate avoidance of rotor blade and stator vane natural frequencies or to reduce the amplitude of rotor blade resonant response at these frequencies. More specifically, within such designs the number of stator vanes is varied in one or more sectors of the stator vane assembly. Although the stator vane spacing may vary from one sector to the next, the stator vanes within each sector remain equally spaced relative to each other, and/or are designed with an equal pitch. The variation in vane spacing or pitch between stator vane sectors facilitates changing the frequency of the vane wakes to reduce the vibration response induced in adjacent rotor blades. However, as a result, circumferentially-spaced stator vane sectors are now different from each other and must be assembled in a certain relative order. Accordingly, the benefits derived from the variable or non-uniform stator vane spacing may be reduced or lost completely by misassembly of the stator vane sectors.

BRIEF DESCRIPTION OF THE INVENTION

In one aspect of the invention, a method of assembling a gas turbine engine is provided. The method includes providing a plurality of stator vane sectors that each include an equal number of stator vanes that are circumferentially-spaced such that a first circumferential spacing is defined between each pair of adjacent stator vanes within the sector, and coupling the plurality of stator vane sectors together to form a stator vane assembly such that a second circumferential spacing is defined between each pair of adjacent stator vanes coupled to adjacent sectors, wherein the second circumferential spacing is different from the first circumferential spacing.

In another aspect, a stator vane assembly for a gas turbine engine is provided. The stator vane assembly includes a plurality of stator vane sectors, each of the plurality of stator vane sectors including an equal number of circumferentially-spaced stator vanes oriented such that a first circumferential spacing is defined between each pair of adjacent stator vanes within each sector. The plurality of stator vane sectors are coupled together such that a second circumferential spacing is defined between each pair of adjacent stator vanes coupled to adjacent sectors. The second circumferential spacing is different from the first circumferential spacing.

In another aspect, a gas turbine engine is provided that includes a compressor that defines an annular flow path. The compressor includes a rotor disk positioned in the flow path, the rotor disk including a plurality of rotor blades, and a stator vane assembly positioned in the flow path downstream of the rotor disk. The stator vane assembly includes a plurality of stator vane sectors, each of the plurality of stator vane sectors including an equal number of circumferentially-spaced stator vanes oriented such that a first circumferential spacing is defined between each pair of adjacent stator vanes within each sector. The plurality of stator vane sectors are coupled together such that a second circumferential spacing is defined between each pair of adjacent stator vanes coupled to adjacent sectors. The second circumferential spacing is different from the first circumferential spacing.

DETAILED DESCRIPTION OF THE INVENTION

Figure 1:
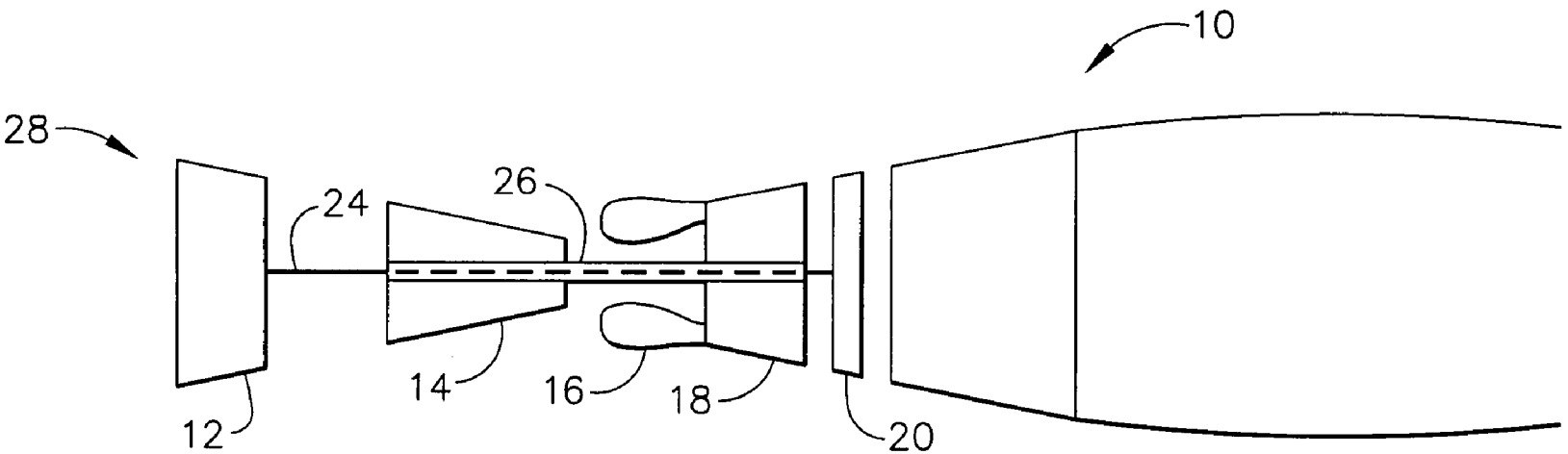
FIG. 1 is a schematic illustration of an exemplary gas turbine engine.

FIG. 1 is a schematic illustration of an exemplary gas turbine engine 10. Engine 10 includes a low pressure compressor 12, a high pressure compressor 14, and a combustor assembly 16. Engine 10 also includes a high pressure turbine 18, and a low pressure turbine 20 arranged in a serial, axial flow relationship. Compressor 12 and turbine 20 are coupled by a first shaft 24, and compressor 14 and turbine 18 are coupled by a second shaft 26.

In operation, air flows through low pressure compressor 12 from an upstream side 28 of engine 10. Compressed air is supplied from low pressure compressor 12 to high pressure compressor 14. Compressed air is then delivered to combustor assembly 16 where it is mixed with fuel and ignited. Combustion gases are channeled from combustor 16 to drive turbines 18 and 20.

Figure 2:
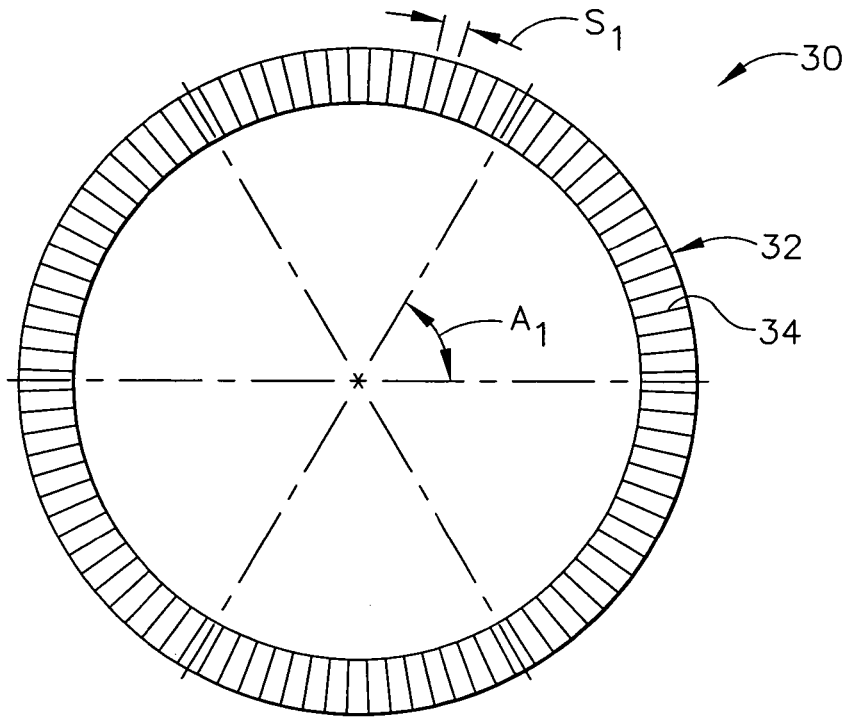
FIG. 2 (PRIOR ART)
FIG. 2 is a schematic end view of a known stator vane assembly.

FIG. 2 is a schematic end view of a known stator vane assembly 30. High pressure compressor 14 defines an annular flow path therethrough and includes at least one rotor disk (not shown) that includes a plurality of circumferentially-spaced, radially-extending rotor blades (not shown). A stator vane assembly, such as stator vane assembly 30 is adjacent to, and downstream from, the rotor disk. In the exemplary embodiment, stator vane assembly 30 includes six circumferentially-spaced stator vane sectors 32, wherein each stator vane sector 32 includes sixteen circumferentially-spaced stator vanes 34. Accordingly, in the exemplary embodiment, stator vase assembly 30 includes a total of ninety six stator vanes 34 with a substantially uniform circumferential or pitch spacing $S_1$ defined between each pair of adjacent stator vanes 34 around the circumference of stator vane assembly 30. Each stator vane sector 32 encompasses a radial arc $A_1$ of about sixty degrees.

Figure 3:
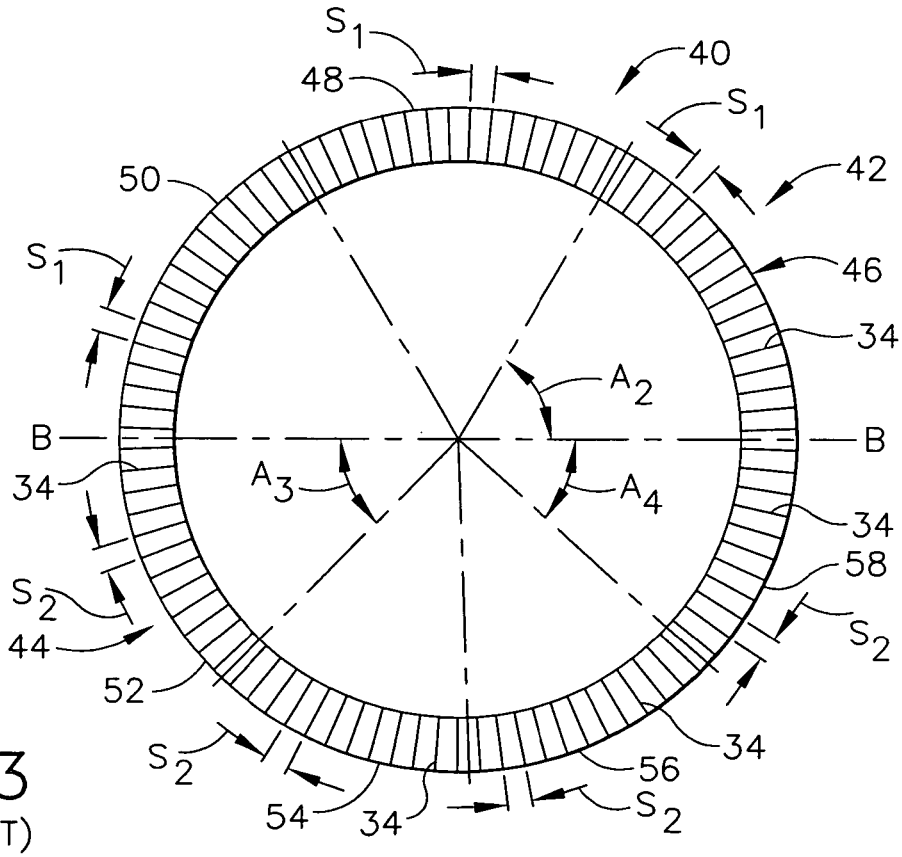
FIG. 3 (PRIOR ART)
FIG. 3 is a schematic end view of a known stator vane assembly including bi-sector non-uniform vane spacing (NUVS)

FIG. 3 is a schematic end view of a known stator vane assembly 40 that includes bi-sector non-uniform vane spacing (Bi-Sector NUVS) to facilitate reducing vibrational stresses induced to an adjacent row of rotor blades (not shown). Stator vane assembly 40 is divided along line B—B and includes an upper half 42 and a lower half 44. Upper half 42 includes three circumferentially-spaced stator vane sectors 46, 48, and 50, each of which is identical and encompasses a radial arc $A_2$ of about sixty degrees. Each upper stator vane sector 46, 48, and 50 includes sixteen circumferentially-spaced stator vanes 34 that have a substantially uniform pitch or spacing $S_1$ between each pair of circumferentially-adjacent stator vanes 34.

Stator vane assembly lower half 44 includes three identical stator vane sectors 52, 54, and 56, and one additional stator vane sector 58. Each of vane sectors 52, 54 and 56 has a radial arc $A_3$ of about forty-six degrees, and each includes twelve stator vanes 34 that are circumferentially spaced with pitch spacing $S_2$. Stator vane sector 58 has a radial arc $A_4$ of about forty-two degrees and includes only eleven stator vanes 34, also of pitch spacing $S_2$. Stator vane assembly 40 has a total of ninety-five stator vanes 34 with one half of the circumference having a pitch spacing $S_2$ that differs from the pitch spacing $S_1$ defined within vane sectors 46, 48 and 50.

Vane sector pitch spacing $S_2$ is varied relative to the remainder of stator vane assembly 40 to facilitate inducing a non-uniformity in the pitch spacing of stator vane assembly 40. Non-uniform pitch spacing of stator vanes 34 facilitates changing the excitation induced to the adjacent rotor air foil (not shown) from the air stream wakes of stator vanes 34, and thereby the non-uniform spacing also facilitates reducing the vibrational response of the rotor blades resulting from the combination of the rotational speed of compressor 14 and the number of stator vanes 34, or the vane count. By varying the spacing of stator vanes 34, each of the rotor blades effectively "sees" a different stator vane count as the rotor blades rotate such that the frequency content of the stator vane wakes around the circumference of compressor 14 is effectively changed.

Stator vane assembly 40 has been illustrated with only one non-uniform stator vane sector configuration, the bi-sector. However, it is to be understood that NUVS stator vane assemblies, such as vane assembly 40, may include multiple other non-uniform sector configurations. In comparison to other known stator vane assemblies such as assembly 30, when the pitch spacing of the vane sectors is varied around the circumference of compressor 14, the stator vane sectors of stator vane assembly 40 are no longer identical to each other, thus creating a potential for misassembly of stator vane assembly 40. If incorrect sectors are installed in the assembly, or if the stator vane sectors are improperly oriented, benefits derived from assembly 40 may be reduced or eliminated.

Figure 4:
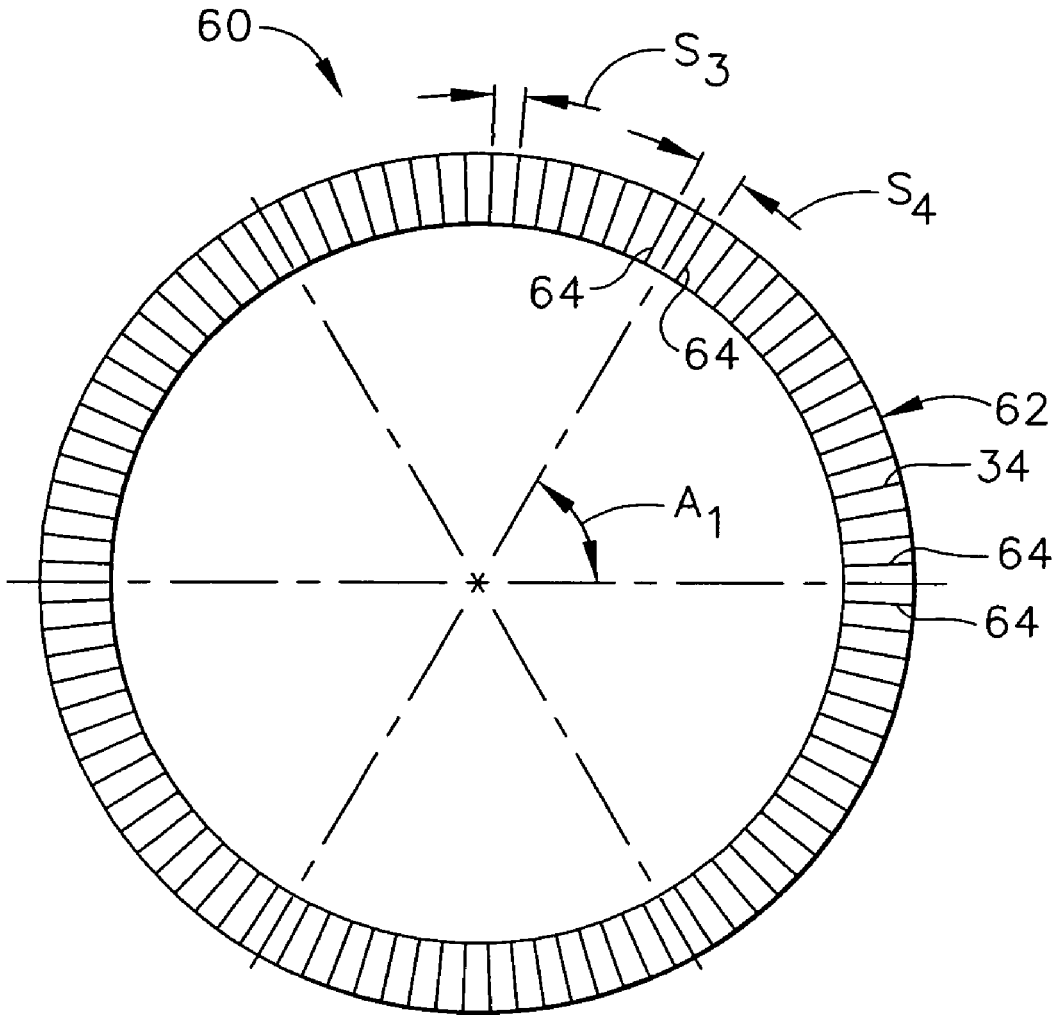
FIG. 4 is a schematic end view of an exemplary stator vane assembly with non-uniform vane spacing (NUVS) at adjacent sector end vanes.

FIG. 4 is a schematic end view of an exemplary stator vane assembly 60 including non-uniform vane spacing (NUVS) defined at adjacent sector end vanes 64. In the exemplary embodiment; stator vane assembly 60 includes six circumferentially-spaced stator vane sectors 62, wherein each stator vane sector 62 includes sixteen circumferentially-spaced stator vanes 34. Each stator vane sector 62 includes a pair of end stator vanes 64 that are identical to stator vanes 34, such that there is a total of ninety six stator vanes 34 included in an assembled stator vane assembly 60 and each stator vane sector 62 has an arc $A_1$ of about sixty degrees. Within each stator vane sector 62, a uniform pitch spacing $S_3$ is defined between adjacent stator vanes 34. Pitch spacing $S_3$ is adjusted such that at the abutting ends 66 of stator vane sectors 62, a pitch spacing $S_4$ defined between adjacent end vanes 64 is greater than the pitch spacing $S_3$.

Non-uniform vane spacing $S_3$ and $S_4$ facilitates reducing vibrational stresses induced to adjacent rotor blades (not shown). More specifically, the vibrational stress reduction is substantially equivalent to that of bi-sector NUVS stator vane assemblies 40, but allows the use of common stator vane sectors 62 circumferentially around assembly 60 such that misassembly risks are reduced in comparison to those associated with assembly 40. Accordingly, rather than a variation in stator vane count, the change in pitch spacing from $S_3$ to $S_4$ facilitates generating a phase shift in the excitation frequency around the circumference of compressor 14.

Figure 5:
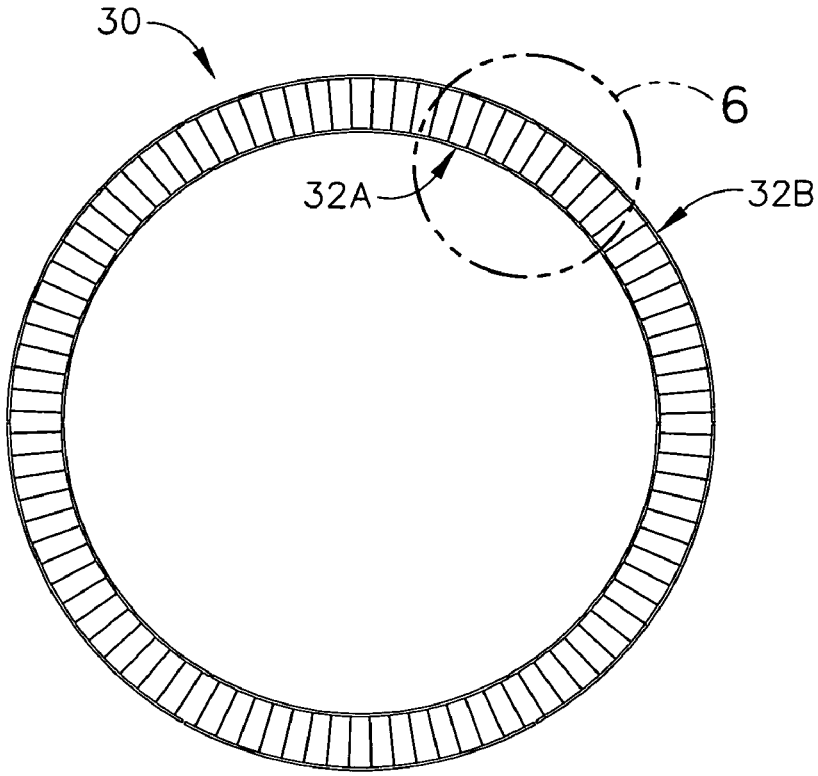
FIG. 5 (PRIOR ART)
FIG. 5 is a schematic end view of the known stator vane assembly shown in FIG. 2.
Figure 6:
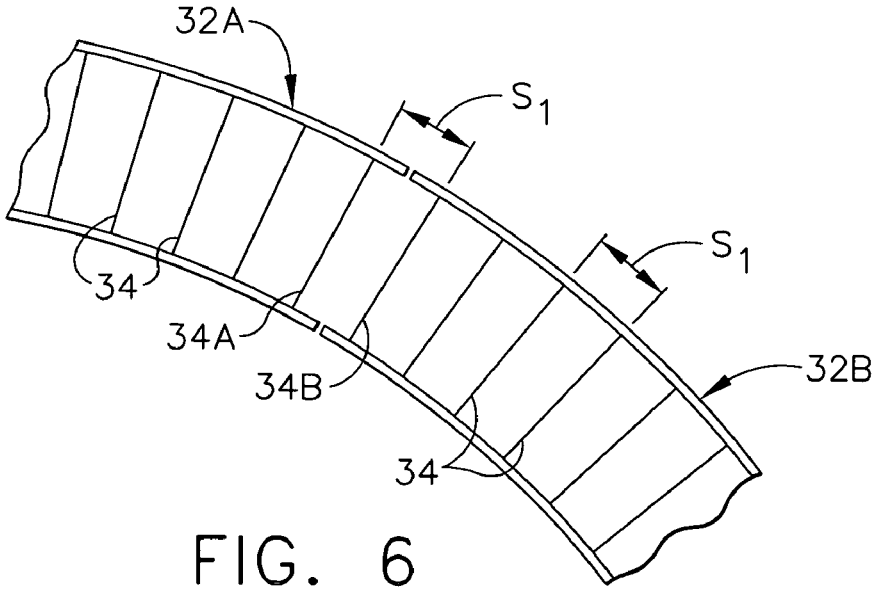
FIG. 6 (PRIOR ART)
FIG. 6 is an enlarged fragmentary view of the stator vane assembly shown in FIG. 5 and illustrating end stator vane spacing at adjacent vane sectors.

FIG. 5 is a schematic end view of stator vane assembly 30. FIG. 6 is an enlarged fragmentary view of stator vane assembly 30 as shown in FIG. 5, illustrating the stator vane pitch spacing $S_1$ at the end vanes 34A and 34B of adjoining stator vane sectors of stator vane assembly 30. More specifically, stator vane assembly 30 is illustrated with sector lines removed, and a portion of abutting stator vane segments 32A and 32B are illustrated enlarged. Stator vane segments 32A and 32B each include an identical number of stator vanes 34. For stator vane assembly 30, pitch spacing $S_1$ defined between adjacent end vanes 34A and 34B is substantially identical to that defined between adjacent stator vanes 34 within each stator vane sector 32A and 32B.

Figure 7:
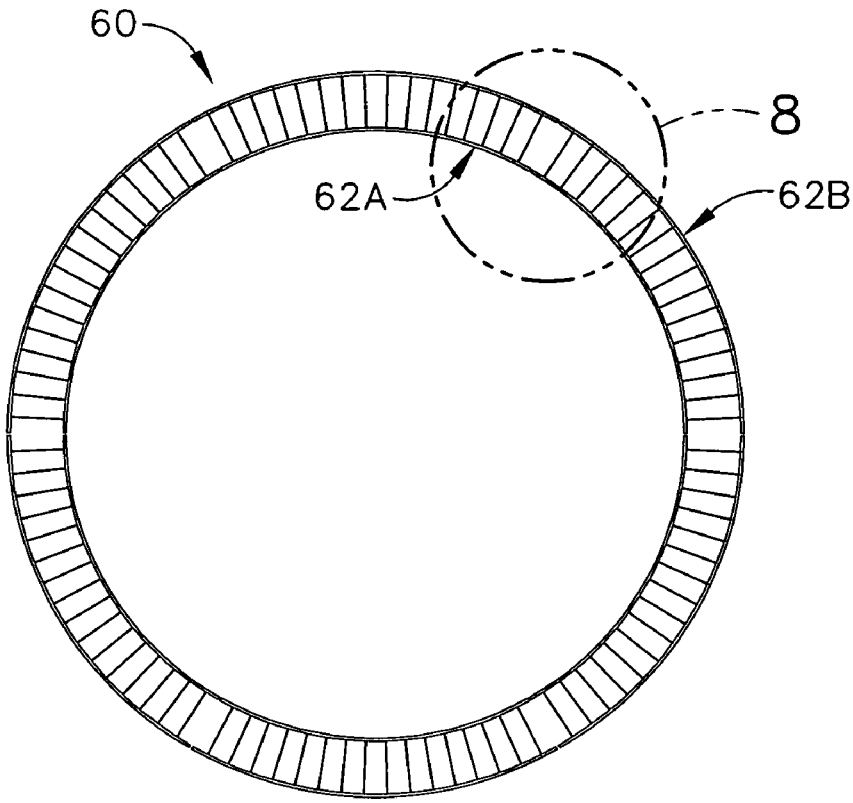
FIG. 7 is a schematic end view of the stator vane assembly shown in FIG. 4.
Figure 8:
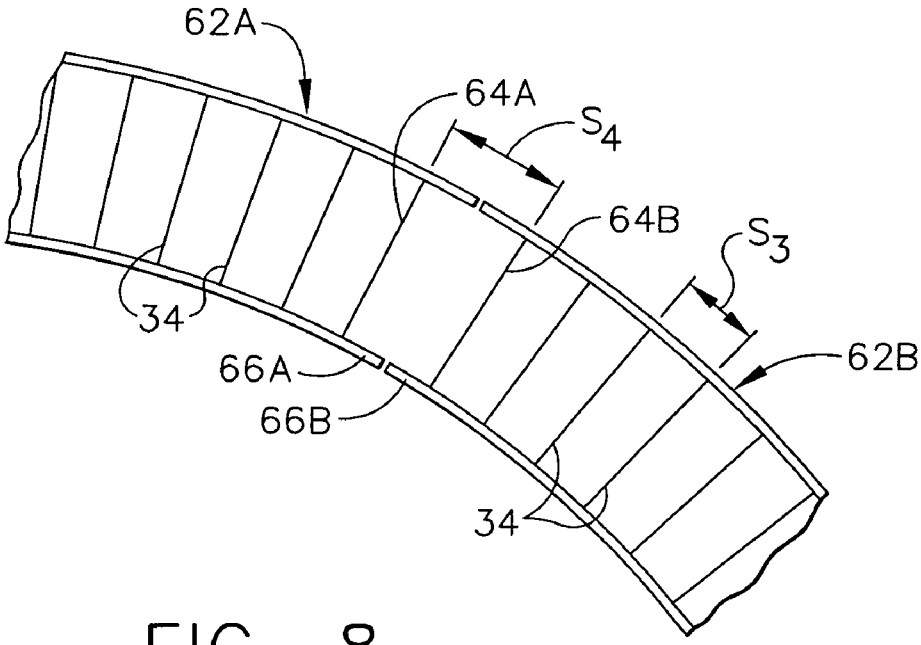
FIG. 8 is an enlarged fragmentary view of the stator vane assembly shown in FIG. 7 and illustrating end stator vane spacing at adjoining vane sectors.

FIG. 7 is a schematic end view of stator vane assembly 60. FIG. 8, is an enlarged fragmentary view of stator vane assembly 60 as shown in FIG. 7, illustrating end stator vane spacing $S_4$ defined at adjoining vane sectors 62A and 62B. Stator vane assembly 60 is illustrated with sector lines removed and a portion of abutting stator vane segments 62A and 62B are illustrated enlarged. Stator vane segments 62A and 62B each include an identical number of stator vanes 34 including end vanes 64A and 64B. For stator vane assembly 60, pitch spacing $S_4$ defined between adjacent end vanes 64A and 64B is greater than pitch spacing $S_3$ defined between adjacent stator vanes 34 within stator vane sectors 62A and 62B. In an exemplary embodiment, pitch spacing $S_4$ is about one hundred fifty percent of that of pitch spacing $S_3$. It is to be understood, however, that other spacing ratios are also contemplated.

Stator vane assembly 60 has been shown to yield substantially the same reduction in peak response as vane assembly 40 but with uniform stator vane sectors 62 that facilitate error free assembly of vane assembly 60. As an example, one conventional stator vane assembly 30, as shown in FIG. 2, and which has no non-uniform vane spacing, experienced a maximum adjacent rotor blade vibration response during testing. With a bi-sector NUVS stator vane assembly, such as stator vane assembly 40, the maximum adjacent rotor blade vibration response was reduced to about sixty-eight percent of the peak response with stator vane assembly 30.

Maximum adjacent rotor blade vibration response for stator vane assembly 60, which employs uniform stator pitch spacing $S_3$ within each stator vane sector 62 and increased pitch spacing $S_4$ between end vanes at abutting ends 66 of stator vane sectors 62 (see FIGS. 4 and 8), was reduced to approximately sixty-seven percent of the peak response experienced with stator vane assembly 30.

Stator vane assemblies 30, 40, and 60 have been illustrated with stator vane sectors numbering from six to seven. It is to be understood that the number of sectors in either configuration can be varied based on the size or vane count in each sector. Obviously, the larger the sector, the fewer that are required to form a circumferential vane assembly. From a practical standpoint, four sectors, with each sector spanning about ninety degrees, is considered to be a reasonable minimum number of stator vane sectors for fabricating a stator vane assembly.

In operation, stator vane assembly 60 is assembled simply by ganging together an appropriate number of identical stator vane sectors 62 to form a completed circumferential stator vane assembly 60 which is then coupled to an inner casing (not shown) of compressor 14 using conventional methods.

The above described stator vane assembly provides a cost effective method for reducing peak rotor blade vibration response due to stator vane excitation. The apparatus provides a reduction in blade response that is substantially equivalent to that of bi-sector NUVS stator vane assemblies, but allows the use of common stator vane sectors that eliminate the risk of misassembly of the stator vane assembly and reduces the overall engine part count.

Exemplary embodiments of stator vane assemblies are described above in detail. The stator vane assemblies are not limited to the specific embodiments described herein, but rather, components and concepts of each assembly may be utilized independently and separately from other components and concepts described herein. For example, each stator vane assembly component can also be used in combination with other stator vane components.

While the invention has been described in terms of various specific embodiments, those skilled in the art will recognize that the invention can be practiced with modification within the spirit and scope of the claims.

What is claimed is:

1. A method of assembling a gas turbine engine, said method comprising:

providing a plurality of stator vane sectors that each include an equal number of stator vanes that are circumferentially-spaced such that a first circumferential spacing is defined between each pair of adjacent stator vanes within the sector; and coupling the plurality of stator vane sectors together to form a stator vane assembly such that a second circumferential spacing is defined between each pair of adjacent stator vanes coupled to adjacent sectors, wherein the second circumferential spacing is different from the first circumferential spacing, such that the second circumferential spacing is about one hundred fifty percent of the first circumferential spacing.

2. A method in accordance with claim 1 wherein coupling the plurality of stator vane sectors together to form a stator vane assembly further comprises coupling at least four stator vane sectors together to form a circumferential assembly.

3. A method in accordance with claim 1 wherein coupling the plurality of stator vane sectors together to form a stator vane assembly further comprises coupling the plurality of stator vane sectors together such that the second circumferential spacing is greater than the first circumferential spacing.

4. A stator vane assembly for a gas turbine engine, said stator vane assembly comprising a plurality of stator vane sectors, each of said plurality of stator vane sectors comprising an equal number of circumferentially-spaced stator vanes oriented such that a first circumferential spacing is defined between each pair of adjacent stator vanes within each said sector, said plurality of stator vane sectors coupled together such that a second circumferential spacing is defined between each pair of adjacent stator vanes coupled to adjacent sectors, said second circumferential spacing is different from, and is about one hundred fifty percent of, said first circumferential spacing.

5. A stator vane assembly in accordance with claim 4 wherein each of said plurality of stator vane sectors further comprises a first end and an opposite second end, each of said first and second ends comprising an end stator vane, adjacent stator vane sectors coupled together such that adjacent end stator vanes coupled to respective stator vane sectors are separated by said second circumferential spacing.

6. A stator vane assembly in accordance with claim 4 wherein said plurality of stator vane sectors are coupled together to form a circumferential assembly.

7. A stator vane assembly in accordance with claim 4 wherein each of said stator vane sectors defines a portion of a flow path extending through the engine.

8. A stator vane assembly in accordance with claim 7 wherein a rotor disk comprises a plurality of circumferentially-spaced rotor blades, said second circumferential spacing facilitates reducing a vibration response induced to said plurality of rotor blades.

9. A stator vane assembly in accordance with claim 7 wherein a rotor disk comprises a plurality of circumferentially-spaced rotor blades, said second circumferential spacing facilitates inducing a phase shift in a vane wake to facilitate reducing a vibration response of said plurality of rotor blades.

10. A stator vane assembly in accordance with claim 4 wherein said plurality of stator vane sectors comprise at least four stator vane sectors.

11. A stator vane assembly in accordance with claim 4 wherein said second circumferential spacing is greater than said first circumferential spacing.

12. A gas turbine engine comprising:

a compressor, said compressor defining an annular flow path, said compressor comprising:

a rotor disk positioned in said flow path, said rotor disk comprising a plurality of circumferentially-spaced rotor blades; and a stator vane assembly positioned in said flow path downstream of said rotor disk, said stator vane assembly comprising a plurality of stator vane sectors, each of said plurality of stator vane sectors comprising an equal number of circumferentially-spaced stator vanes oriented such that a first circumferential spacing is defined between each pair of adjacent stator vanes within each said sector, said plurality of stator vane sectors coupled together such that a second circumferential spacing is defined between each pair of adjacent stator vanes coupled to adjacent sectors, said second circumferential spacing is different from, and is about one hundred fifty percent of, said first circumferential spacing.

13. A gas turbine engine in accordance with claim 12 wherein each of said plurality of stator vane sectors further comprises a first end and an opposite second end, each of said first and second ends comprising an end stator vane, adjacent stator vane sectors coupled together such that adjacent end stator vanes coupled to respective stator vane sectors are separated by said second circumferential spacing.

14. A gas turbine engine in accordance with claim 12 wherein said plurality of stator vane sectors comprise at least four stator vane sectors.

15. A gas turbine engine in accordance with claim 12 wherein said second circumferential spacing is greater than said first circumferential spacing.

16. A gas turbine engine in accordance with claim 12 wherein said second circumferential spacing facilitates reducing a vibration response induced to said plurality of rotor blades.

17. A gas turbine engine in accordance with claim 12 wherein said second circumferential spacing facilitates inducing a phase shift in a vane wake to facilitate reducing said vibration response of said plurality of rotor blades.

* * * * *